US006024063A

United States Patent [19]

Muter et al.

[11] Patent Number: 6,024,063

[45] Date of Patent: Feb. 15, 2000

[54] CAMSHAFT LASH ADJUSTMENT PROCESS AND SYSTEM FOR INTERNAL COMBUSTION ENGINE

[75] Inventors: Doreen Jeanette Muter, Belleville; William Charles Ronzi, Farmington Hills; Douglas David Cantrell, Jr., Ann Arbor; Thomas Patrick Durfee, Redford; Thomas Kenneth Wagel, Gross Ile, all of Mich.

[73] Assignee: Ford Global Technologies, Inc., Dearborn, Mich.

[21] Appl. No.: 09/332,374

[22] Filed: Jun. 14, 1999

[51] Int. Cl.[7] ..... F01L 1/20

[52] U.S. Cl. ..... 123/90.27; 123/90.52; 123/90.6

[58] Field of Search ..... 123/90.17, 90.27, 123/90.31, 90.52, 90.6

[56] References Cited

U.S. PATENT DOCUMENTS

| | | | |
|---|---|---|---|
| 4,438,737 | 3/1984 | Burandt | 123/90.17 |
| 4,541,372 | 9/1985 | Weiss | 123/90.17 |
| 4,552,112 | 11/1985 | Nagao et al. | 123/432 |
| 5,562,072 | 10/1996 | Stoody, Jr. | 123/90.27 |
| 5,645,020 | 7/1997 | Yamada | 123/90.17 |

*Primary Examiner*—Weilun Lo

*Attorney, Agent, or Firm*—Jerome R. Drouillard

[57] ABSTRACT

A camshaft lash adjustment process for an internal combustion engine includes the steps of substituting a tiltable camshaft retainer for a camshaft bearing cap which is proximate a driven end of the camshaft, followed by removal of all remaining camshaft bearing caps and the substitution of a camshaft tilt limiter for one of the camshaft bearing caps so as to allow rotation of the camshaft to a tilted position. This permits adjustment of valve tappets driven by the camshaft.

12 Claims, 2 Drawing Sheets

CAMSHAFT LASH ADJUSTMENT PROCESS AND SYSTEM FOR INTERNAL COMBUSTION ENGINE

BACKGROUND OF THE INVENTION

1. Field of the Invention

The present invention relates to internal combustion engines having direct acting camshaft and tappet arrangements.

2. Discussion of Prior Art

Poppet valve drive arrangements for internal combustion engines typically utilize either hydraulic lash adjusters or manually adjustable tappets or rockers. In the event that hydraulic lash adjusters are not employed, it is necessary to periodically re-measure the lash and provide necessary shims and/or other adjustments in order to permit necessary clearance between the cam lobe on its base circle and the accompanying valve tappet.

With overhead camshaft engines equipped with direct acting mechanical bucket tappets, it is necessary to measure the lash and then provide the required shims. This is often done by removing shims, in which case it is necessary with many engines to physically displace the camshaft to allow access to the tappets. With four-valve cylinder heads, access to the tappets is typically very limited and requires considerable displacement of the camshaft. This, in turn, may create problems if, for example, a camshaft drive chain or belt tensioner automatically rachets to take up slack in the chain drive or belt mechanism. It is understood that tilting of the camshaft may result in temporary displacement of the camshaft drive sprocket in a direction introducing slack in the drive chain or belt.

If tilting of camshaft results in taking up play by an automatically racheting tensioner, catastrophic results may ensue if the engine is not freewheeling, i.e., if the engine's pistons are not clearanced to remain free of the valves should the valves be open when the piston is at top dead center, as during the overlap period between the exhaust and intake strokes. And, even where a tensioner maladjustment is discovered prior to placing the engine back in service, a time-consuming repair will be necessitated because removal of the engine's front cover will, in all likelihood, be needed.

It is known to tilt the camshaft to allow access to mechanical tappets or buckets so as to allow adjustment of the tappets, and this process is typically done by wedging an object under the camshaft. A problem with this practice is that while merely wedging an object under the camshaft, it is difficult to determine how far the camshaft may be lifted without causing a problem with a chain or belt tensioner, as described above.

A system and method according to the present invention provides a reliable and repeatable method and means for lifting and tilting a camshaft sufficiently to allow access to the underlying tappets, without engendering risk that the camshaft drive tensioner will erroneously actuate and without risking damage to the camshaft.

SUMMARY OF THE INVENTION

A camshaft lash adjustment process for an internal combustion engine having at least one camshaft journaled within a plurality of bearings within a cylinder head for the purpose of driving direct acting valve tappets, with the camshaft being driven at one end by a drive mechanism, includes the steps of substituting a tiltable camshaft retainer for a camshaft bearing which is proximate the driven end of the camshaft, by installing a tiltable camshaft retainer in the place of the bearing, followed by removal of all the remaining camshaft bearings and by substitution of a camshaft tilt limiter for one of the other bearings.

The tilt limiter is installed in the place of one of the camshaft bearings other than the bearing replaced by the tiltable retainer. Thereafter, the camshaft is rotated about an axis which is perpendicular to the camshaft center line such that the camshaft rotates within the tiltable retainer while moving from its installed position to a maximum tilt position defined by the tilt limiter.

While in the maximum tilt position, the valve tappets actuated by the camshaft will be exposed to an extent sufficient to permit the tappets to be adjusted. The tiltable camshaft retainer and tilt limiter are removed when the adjustment process is over and the camshaft bearings are restored to place the engine back in operation.

In any event, the maximum amount of rotation provided by the tiltable camshaft retainer and tilt limiter is insufficient to allow the camshaft to either become disengaged from its drive mechanism or to cause a tensioner to ratchet to another setting.

According to another aspect of the present invention, a camshaft lash adjustment support system for use with an engine having an overhead camshaft mounted within the cylinder head and with the camshaft being driven at one end by a camshaft drive mechanism, includes a tiltable camshaft retainer adapted for mounting upon the cylinder head, with the retainer locating the driven end of the camshaft while allowing the camshaft to be tilted about an axis extending through the tiltable retainer at a right angle to the camshaft center line.

A tilt limiter, adapted for mounting upon a cylinder head, allows the camshaft to tilt by an amount sufficient to expose tappets located under the camshaft, without allowing the camshaft to tilt sufficiently to permit the driven end of the camshaft to become disengaged from the camshaft drive mechanism, or to allow the camshaft drive mechanism to permanently shorten the camshaft drive chain or belt.

It is an advantage of the present invention that use of the present method and system will allow adjustment of camshaft lash in an engine without an improper change in the relationship between the crankshaft and the camshaft occasioned by improper tensioning of the chain resulting from a spatial difference in the separation between the camshaft sprocket and the drive sprocket on the engine's crankshaft.

It is another advantage of the present invention that use of the present method and system will prevent damage to the camshaft which might otherwise be occasioned by the use of makeshift tools for the purpose of positioning and tilting the camshaft during a lash adjustment procedure. This prevention of damage to the camshaft, according to the present invention, is further promoted by the fact that a tiltable camshaft retainer according to the present invention, allows tilting movement of a camshaft without placing undue strain upon the camshaft and without causing damage to an improperly applied camshaft bearing cap according to prior art practice. In the prior art, technicians would loosely bolt a conventional camshaft bearing cap in place at the camshaft bearing journal closest to the drive chain or belt. Unfortunately, this practice could cause damage to either the camshaft, or the bearing cap, or both. This problem is eliminated by the present invention.

Another advantage of the present invention resides in the fact that a tiltable camshaft retainer and tilt limiter according to this invention may be mounted to the engine in either of two directions, thereby further obviating the problem of mis-installed service fixtures.

DETAILED DESCRIPTION OF PREFERRED EMBODIMENT(S)

Figure 1:
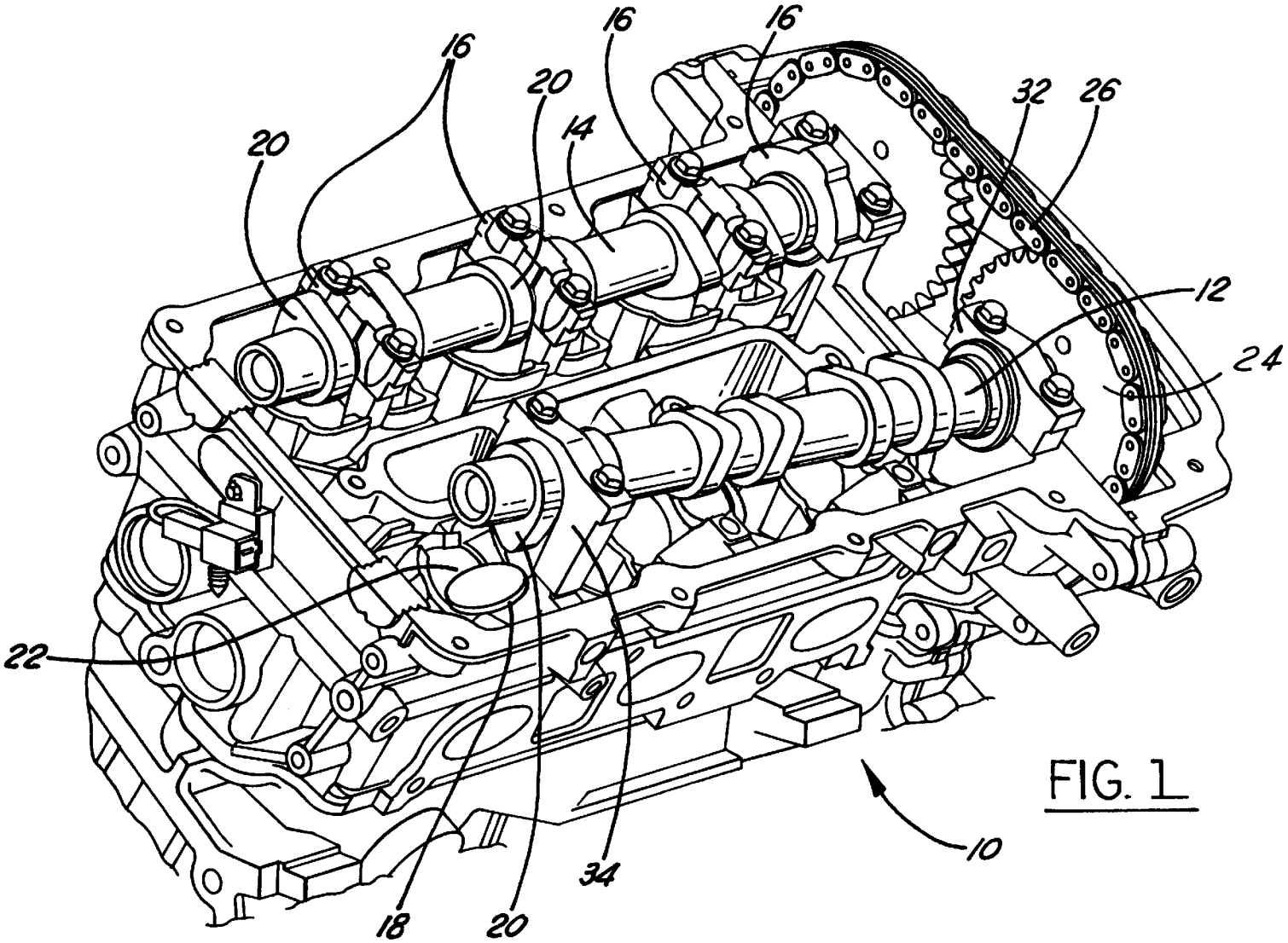
FIG. 1 is a perspective view of a cylinder head having camshaft adjustment tools applied according to the present invention.

As shown in FIG. 1, cylinder head 10 is equipped with two overhead camshafts, namely exhaust camshaft 12 and intake camshaft 14. Each of camshafts 12 and 14 has a plurality of cam lobes 20 formed thereon.

Those skilled in the art will appreciate in view of this disclosure that a system and method according to the present invention could be used with engines having a single overhead cam, two overhead cams, or three or more overhead camshafts. Intake camshaft 14 is shown as being fully mounted on cylinder head 10 by means of camshaft bearing caps 16, which are four in number. Exhaust camshaft 12 is shown in a fully tilted position according to one aspect of the present invention.

Camshafts 12 and 14 are each driven by means of timing chain 26, with sprocket 24 being attached to the front or driven end of exhaust camshaft 12 for the purpose of driving exhaust camshaft 12. A chain tensioner (not shown), which is conventional in construction, is used for maintaining an acceptable amount of slack in chain 26. Those skilled in the art will appreciate in view of this disclosure, of course, that an elastomeric belt and accompanying tensioner could be used in lieu of chain 26 for the purpose of driving camshafts 12 and 14.

Figure 2:
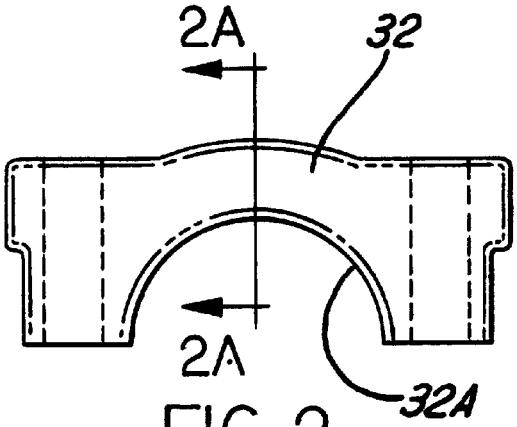
FIGS. 2 and 2A illustrate a tiltable camshaft retainer according to one aspect of the present invention.
Figure 3:
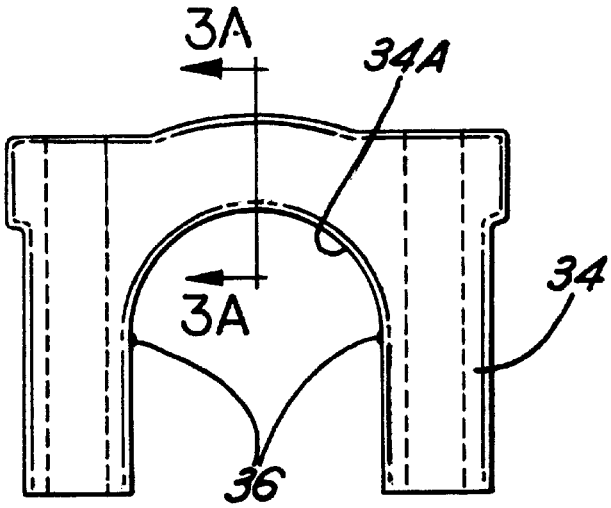
FIGS. 3 and 3A illustrate a camshaft tilt limiter according to one aspect of the present invention.

Camshaft 12 is maintained in contact with and mounted upon cylinder head 10 by means of tiltable camshaft retainer 32 and camshaft tilt limiter 34, which are shown in greater detail in FIGS. 2 and 3, respectively.

Figure 2A:
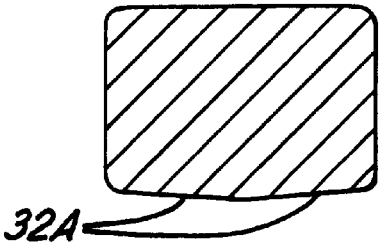

Beginning now with FIG. 2, tiltable camshaft retainer 32 is illustrated as a modified cap-type mechanism having a semicircular surface 32A, which is also, as shown in FIG. 2A, convex. Convex surface 32A allows camshaft 12, or camshaft 14 for that matter, to be tilted without damage to either tiltable camshaft retainer 32 or to the camshaft. This obviates the need for attempting to obtain controllable tilting of camshaft 12 by the installation of one of the camshaft bearing caps 16 in a position at the front of the camshaft—a practice which is not calculated to allow adjustment of the valve lash without damage to either the camshaft or the bearing cap itself.

Figure 3A:
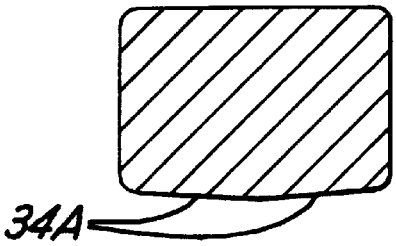

FIGS. 3 and 3A illustrate the design of camshaft tilt limiter 34, which has a semicircular convex surface 34A formed thereon so as to allow camshaft 14 to tilt up to a predetermined maximum amount. It is noted in this regard that the portion of camshaft 12 proximate camshaft tilt limiter 34 will be a greater distance away from the balance of cylinder head 10 than will the portion of camshaft 12 extending within tiltable camshaft retainer 32.

Once tiltable camshaft retainer 32 and camshaft tilt limiter 34 have been installed upon camshaft 12, shim 18 may be removed and replaced with an appropriate shim. Those skilled in the art will appreciate in view of this disclosure that repeated installation, removal and reinstallation of camshaft bearing caps 16, camshaft tilt limiter 34, and tiltable retainer 32 may be required to set valve lash. In other words, an iterative process may be needed to achieve proper valve lash. In any event, the process of installing tiltable camshaft retainer 32 and camshaft tilt limiter 34 remains the same.

It is easily seen from FIG. 1, that tiltable camshaft retainer 32 and camshaft tilt limiter 34 act together to prevent camshaft sprocket 24 from moving too close to the engine crankshaft so as to prevent the chain drive tensioner from taking up temporary slack in the chain, thereby avoiding a potential valve timing problem.

FIG. 3 also illustrates projections 36 formed on the inner surface of camshaft tilt limiter 34 adjacent surface 34A. Projections 36 allow camshaft 12 or camshaft 14 to be snapped in place manually to the tilted position by a service technician. Thereafter, the camshaft will be held in a tilted position so as to allow removal of one or more shims 18.

While the invention has been shown and described in its preferred embodiments, it will be clear to those skilled in the arts to which it pertains that many changes and modifications may be made thereto without departing from the scope of the invention.

We claim:

1. A camshaft lash adjustment process for an internal combustion engine having at least one camshaft journaled within a plurality of bearings within a cylinder head for the purpose of driving direct acting valve tappets, with said camshaft being driven at one end by a drive mechanism, with said process comprising the steps of:

substituting a tiltable camshaft retainer for a camshaft bearing cap which is proximate the driven end of the camshaft, by installing said tiltable camshaft retainer in the place of said bearing cap;

removing all remaining camshaft bearing caps;

substituting a camshaft tilt limiter for one of the others of said plurality of bearing caps by installing the tilt limiter in the place of one of said other bearing caps;

rotating the camshaft about an axis which is perpendicular to the camshaft centerline such that the camshaft rotates within the tiltable retainer, while moving from its installed position to a maximum tilt position defined by the tilt limiter, in which position the valve tappets actuated by the camshaft are exposed;

adjusting one or more valve tappets;

removing the tiltable camshaft retainer and the camshaft tilt limiter; and reinstalling the camshaft bearing caps.

2. A camshaft lash adjustment process according to claim 1, wherein said tiltable camshaft retainer and said tilt limiter allow the camshaft to be rotated by a maximum amount sufficient to expose the tappets to permit their adjustment, with said maximum amount of rotation being insufficient to allow the camshaft to become disengaged from said drive mechanism.

3. A camshaft lash adjustment process according to claim 1, wherein said tilt limiter removably retains the camshaft in said maximum tilt position.

4. A camshaft lash adjustment process according to claim 1, wherein said drive mechanism comprises a chain driven by a crankshaft.

5. A camshaft lash adjustment process according to claim 1, wherein said drive mechanism comprises an endless belt driven by a crankshaft.

6. A camshaft lash adjustment support system for use with an engine having an overhead camshaft mounted within a cylinder head, with the camshaft being driven at one end by a camshaft drive mechanism, with said system comprising:

a tiltable camshaft retainer, adapted for mounting upon the cylinder head, for locating the driven end of the camshaft, while allowing the camshaft to be tilted about an axis extending through the tiltable retainer at a right angle to the camshaft centerline; and a tilt limiter, adapted for mounting upon the cylinder head, for allowing the camshaft to tilt by an amount sufficient to expose tappets located under the camshaft, without allowing the camshaft to tilt sufficiently to permit the driven end to become disengaged from the camshaft drive mechanism.

7. A camshaft lash adjustment support system according to claim 6, wherein said tiltable camshaft retainer is adapted for mounting upon the cylinder head in the place of a camshaft bearing cap, with said tiltable camshaft retainer having a convex surface for contacting said camshaft.

8. A camshaft lash adjustment support system according to claim 6, wherein said tilt limiter is adapted for mounting upon the cylinder head in the place of a camshaft bearing cap.

9. A camshaft lash adjustment support system according to claim 6, wherein said tilt limiter further comprises a holder for maintaining the camshaft in a tilted position during adjustment of said tappets.

10. A camshaft lash adjustment support system according to claim 6, wherein said tilt limiter further comprises a convex, semicircular surface for contacting a bearing surface of the camshaft.

11. A camshaft lash adjustment support system according to claim 6, wherein said tiltable camshaft retainer and said tilt limiter are adapted for mounting upon the cylinder head in the place of a plurality of camshaft bearing caps.

12. A camshaft lash adjustment process for an internal combustion engine having a camshaft retained by means of a plurality of bearing caps within a cylinder head for the purpose of driving direct acting valve tappets, with said camshaft being driven at one end by a drive chain, with said process comprising the steps of:

substituting a tiltable camshaft retainer for the camshaft bearing cap which is closest to the driven end of the camshaft, by installing said tiltable camshaft retainer in the place of said bearing cap;

removing all remaining camshaft bearing caps;

substituting a camshaft tilt limiter for one of the others of said plurality of bearing caps by installing the tilt limiter in the place of one of said other bearing caps;

rotating the camshaft about an axis which is perpendicular to the camshaft centerline such that the camshaft rotates within the tiltable retainer, while moving from its installed position to a maximum tilt position defined by the tilt limiter, in which position the valve tappets actuated by the camshaft are exposed, but without rotating the camshaft such that a chain tensioner associated with the drive chain removes any slack from the chain;

adjusting one or more valve tappets;

removing the tiltable camshaft retainer and the camshaft tilt limiter; and reinstalling the camshaft bearing caps.

* * * * *